United States Patent [19]

Moore

[11] 3,939,509

[45] Feb. 24, 1976

[54] LIGHT-WEIGHT BUOY

[76] Inventor: Alvin Edward Moore, 916 Beach Blvd., Waveland, Miss. 39576

[22] Filed: Feb. 24, 1975

[21] Appl. No.: 552,621

Related U.S. Application Data

[63] Continuation of Ser. No. 414,441, Nov. 9, 1973, abandoned, which is a continuation-in-part of Ser. No. 225,386, Feb. 11, 1972, Pat. No. 3,803,651, which is a continuation-in-part of Ser. No. 23,789, March 30, 1970, Pat. No. 3,670,349, said Ser. No. 23,789, is a continuation-in-part of Ser. No. 531,564, March 3, 1966, Pat. No. 3,503,825.

[52] U.S. Cl. ..... 9/8 R; 264/46.9

[51] Int. Cl.[2] ..... B63B 21/52

[58] Field of Search ..... 9/8 R, 8 P, 2 A, 11 A, 9/311, 329, 340, 345; 150/54; 114/.5 F, 49, 52–54; 161/DIG. 5, 159, 161; 273/106 A, 128; 264/46.9

[56] References Cited

UNITED STATES PATENTS

| | | | |
|---|---|---|---|
| 2,410,845 | 11/1946 | Snell et al. | 273/106 B |
| 2,890,467 | 6/1959 | Cowell | 9/345 |
| 2,945,468 | 7/1960 | Payne | 9/8 R |
| 3,111,696 | 11/1963 | ToLo | 9/340 |
| 3,384,867 | 5/1968 | Bridgdes | 9/8 R |
| 3,562,370 | 2/1971 | Shannon | 161/161 |
| 3,710,505 | 1/1973 | Linenfelser | 273/106 B |

*Primary Examiner*—George E. A. Halvosa
*Assistant Examiner*—Stuart M. Goldstein

[57] ABSTRACT

A life buoy or similar article of manufacture (for example, one capable of being used as a construction element), including a doughnut-shaped hollow element, which optionally may be of flexible plastic and contain pressurized gas (optionally helium); but preferably it is a gas-filled toroidal tube of blown glass or metal, permanently sealed, and flanked and protected against shock by foamed plastic (or similar porous material), coated with waterproofing rubber or paint. This hollow element may be cylindrical, spherical or polygonal, but preferably it is doughnut-shaped. The foamed plastic may be limited to the exterior of the hollow element or also may be on its interior. At its center the article may have a cylindrical or toroidal hole; or optionally the foamed plastic may continuously bridge over the hollow element at the center of the article. Such foamed plastic bridging over the article's center in the form of FIG. 10, contains helium balloons, imbedded in the plastic, thus providing a very lightweight buoy or similar article. A modification of the life buoy includes a disk-like horizontal part and an upright central element projecting upward from the disk-like part, aiding a survivor to remain on the buoy in rough weather. The preferred buoyant, toroidal, central tube of blown glass or metal may be filled with air, but optionally it contains helium. This gas cannot escape due to the dense, solid material of the integral toroidal walls of blown glass or the like.

12 Claims, 13 Drawing Figures

FIGURE 1
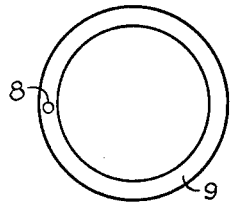
FIGURE 2
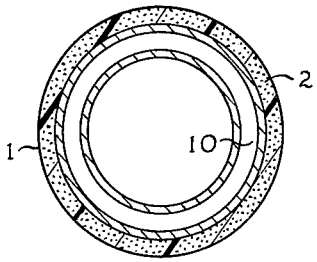
FIGURE 3
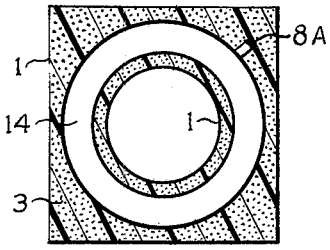
FIGURE 4
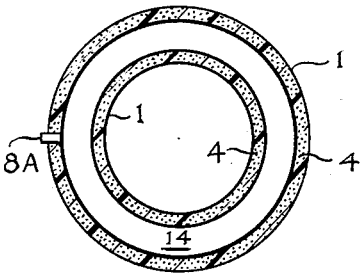
FIGURE 5
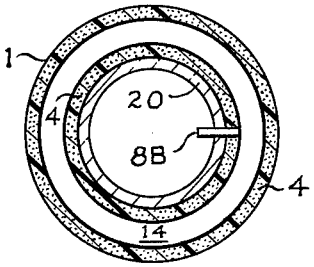
FIGURE 6
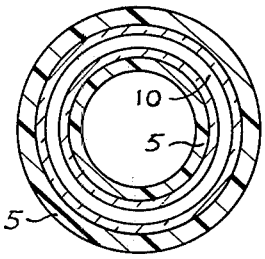
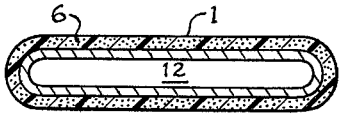
FIGURE 7
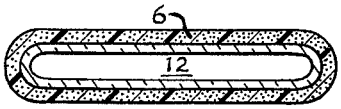
FIGURE 8
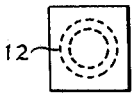
FIGURE 9
FIGURE 9A
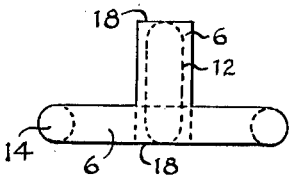
FIGURE 10
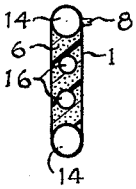
FIGURE 11
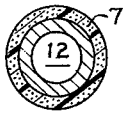
FIGURE 12
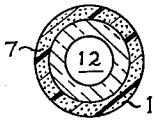

LIGHT-WEIGHT BUOY

This application is a continuation of application Ser. No. 414,441, filed on Nov. 9, 1973 and now abandoned; and application Ser. No. 414,441 was a continuation in part of application Ser. No. 225,386, filed on Feb. 11, 1972, now patent No. 3,803,651, which was a continuation in part of application Ser. No. 23,789, filed on Mar. 30, 1970, now U.S. Pat. No. 3,670,349, the latter application being a continuation in part of application Ser. No. 531,564, filed on Mar. 3, 1966, now U.S. Pat. No. 3,503,825 of Mar. 31, 1970, entitled "Method of Making Light-Weight Article." Excepting slight draftsman's changes, FIGS. 1, 2, 4, 7, 9, 10 and 11 are the same as FIGS. 8, 5, 4, 11, 12, 8A and 9, respectively of application Ser. No. 225,386, and the same as FIGS. 5, 10, 6, 8, 9, 15 and 7, respectively, of application No. 23,789; and FIGS. 2, 7, 9 and 11 are copies of FIGS. 6, 5, 5A and 4, respectively, of application Ser. No. 531,564. Excepting illustration of the hollow element as of glass (previously disclosed in the specifications of application Ser. Nos. 225,386, 23,789 and 531,564). FIGS. 8 and 12 are the same, respectively as FIGS. 11 and 9 of application Ser. No. 23,789, as FIGS. 8 and 7 of application Ser. No. 23,789, as FIGS. 8 and 7 of application Ser. No. 23,789, and as FIGS 5 and 4 of application Ser. No. 531,564. These continuation-in-part features of the present application pertain to invention required to be divided from the said prior applications.

Some objects of the present invention are to provide: (1) a very light-weight, strong and long-lasting life buoy or similar article of manufacture, comprising a hollow element having a high degree of buoyancy, preferably flanked by waterproofed, foamed plastic or the like; (2) a buoy or other article of manufacture having structure of the type of (1) above, in which the hollow element comprises a doughnut-shaped tube or tubes; (3) an article of manufacture as in (1) or (2), in which the hollow element comprises blown glass or metal and is permanently sealed; and (4) an article of each of the above types, comprising foamed plastic within a doughnut-shaped tube and small helium balloons imbedded in the foamed plastic.

The foregoing and other objects of the invention will be more fully apparent from the following detailed description of the invention and the accompanying drawings.

In these drawings:

FIG. 1 is a plan view of one form of the hollow element of the article;

FIG. 2 is a sectional view from a median plane thru one form of the invented article;

FIG. 3 is a view similar to FIG. 2, showing thinner tube material and a polygonal exterior;

FIG. 4 is a sectional view from a median plane thru a second form of the invented structure;

FIG. 5 is a sectional view similar to FIG. 4, showing an article of the general type of FIG. 4, fitted on a cylindrical element;

FIG. 6 is a sectional view of an article similar to that of FIG. 4, comprising a blown-glass tube;

FIG. 7 is a sectional view of an buoy, central buoy part, or other of

FIG. 8 is a view similar to FIG. 7 showing the article of FIG. 7 as having a blown-glass hollow element;

FIG. 9 is an end elevational view of the unit of FIG. 7 (or of FIG. 8), showing an optional end-view configuration of the article of FIG. 7 or FIG. 8;

FIG. 9A is an elevational view of a buoy having an upright central portion projecting above a disk-like part;

FIG. 10, on a reduced scale from that of FIGS. 2 to 6, is a sectional view from a median plane thru another form of the buoy or similar article;

FIG. 11 is a sectional view of a gas-containing cylinder or ball; and

FIG. 12, similar to FIG. 11, illustrates the plastic-surrounded hollow element as a glass cylinder or ball.

In each of its forms the invention comprises: waterproof skin means 1 (preferably a coating of rubber, rubber cement or paint); a hollow element; gaseous material, comprising gas (for example helium or air) or optionally gas-cell-containing foamed plastic inside the hollow element; and foamed plastic, 2 to 7, which flanks and protects the hollow element.

The light-weight, gas-containing hollow element preferably comprises dense, integral, strength-providing material that is sufficiently thick, as shown in FIGS. 2, 6, 7 and 8, to be substantially strong and resistant to breakage or bending. The tube is substantially impermeable to gas, and preferably is hermetically and permanently sealed. Thus no gas can escape from the hollow element, and it is serviceable for a very long period of time. Its material may be blown glass or other material that is sufficiently pasty when heated to be blown into the desired shape within a mold. This material is preferably glass, which may be blown in accordance with the method set forth in the present inventor's U.S. Pat. No. 3,503,825. But optionally the hollow element may comprise other types of walls that are thin and light in weight, optionally non-extensible or expansible, preferably impermeable or nearly impermeable to gas. The material of these optional walls may be: die-pressed thin sheet metal or dense plastic; fiber-reinforced dense plastic or rubber that is only slowly permeable to gas; die-pressed sheets of thin metal, hermetically joined at junctions of the sheets' edges by bonding material; thin, molded or die-formed aluminum, aluminum alloy, very thin iron, steel or copper; balloon cloth (nylon or the like), heavily coated and impregnated with rubber or other plastic, preferably of the dense type, substantially impenetrable to gas.

When the hollow element is metal or dense plastic that is practically impermeable to gas it may be inflated with air or lighter-than-air gas such as helium, optionally at a pressure that is well above that of the atmosphere — for example, of 10 pounds per square inch, and then the inflation hole, tube or valve is permanently sealed. This sealing may be by application of epoxy glue or by welding, brazing, soldering, or fusing if a type of plastic is used that is meltable by heat. If the tube is integrally made, for instance by the molding method of the present inventor's U.S. Pat. No. 3,503,825, it is hermetically sealed in a step of this method.

Another example of a method of making the doughnut-shaped tubes comprises the following steps: (1) die-stamping or molding two equal, half-tube parts, each having an annular flange around its radially outer edge and another concentric annular flange around its radially inner edge; (2) placing the flanges one above the other to form the doughnut-shaped ring; (3) hermetically uniting the contacting faces of the flanges, except a gas inlet (an inflation hole or little pipe or valve tube), by welding, brazing, soldering, fusing of plastic, or epoxy cement; (4) inflating the tube with the selected gas (or with gas-cell-containing foam plastic); and (5) sealing the inflation inlet by bonding material or fused plastic.

Another optional type of the doughnut-shaped tube is made, somewhat like an automobile tire tube, by molding it of resilient synthetic or natural rubber; but unlike a tire tube, its valve tube, in each of the forms of the invention, optionally may be located not at the doughnut-like hole, but instead in the sidewall or in the radially outer wall of the tube. In FIGS. 1 and 10 these inflation inlets 8 are shown in sidewalls of the curved-axis tubes. The valve or other gas inlet 8A of FIG. 3 or FIG. 4 is shown as optionally in a radially outer portion of the tube; and in FIG. 5 the valve 8B is in an interior portion of a tube's walls; but in these figures also, the inlet optionally may be in any one of these three positions. When the article is a life buoy the inlet tube, if any, is preferably in a sidewall or in the radially outer wall of the doughnut-shaped hollow element.

FIG. 1 illustrates a doughnut-shaped or toroidal hollow element 9 before foamed plastic is molded or otherwise formed to flank it. Although the gas inlet 8 (as well as 8A and 8B may be a valve) it preferably is a mere tube, which may be sealed after formation of the hollow element by melting or epoxy-puttying and clamping together the inlet-tube walls, welding them together, hermetically sealing the hollow element. When it is of glass, blown in a mold by a common glass-blowing method, the tube 8 is fairly large, and provides the neck thru which air (or helium) is blown; but when it is of die-stamped and welded-together metal halves the inlet 8 is preferably a valve, permanently sealed over after forcing compressed gas into the hollow element, by solder, welding, epoxy or the like.

The doughnut-shaped hollow element 10 of FIGS. 2 and 6 and the cylindrical or spherical hollow element 12 of FIGS. 7, 8, 11 and 12 are shown as optionally being of relatively thick and strong wall material, resisting breakage or bending of the tube — for example of blown glass or die-stamped metallic halves; but the tubes 14 of FIGS. 3 to 5 and 10 are shown as optionally being of very thin material — for example very thin steel, aluminum alloy, or thin, dense plastic. When the hollow element is of glass its walls preferably are fairly thick as illustrated in FIGS. 6 and 8; but in each of the disclosed inventive forms they optionally may be either fairly thick or thin, depending on the desired strength of the article and its material.

The gaseous material that is inside the hollow element optionally may have a pressure well above that of the atmosphere. This material optionally may be air or heavier-than-air gas, or gas-cell-containing foam plastic (substantially rigid or stiffly resilient and optionally under above-atmospheric pressure); but preferably it comprises lighter-than-air gas, such as helium or nitrogen, optionally pressurized.

Although in each of FIGS. 2 to 6, 9A and 10, the matrix material flanking the hollow toroidal tube may be very light-weight concrete, comprising epoxy or Portland or other cement and very light-weight aggregate (e.g., expanded shale or shredded or ground plastic), it preferably is foamed plastic (optionally resilient but preferably substantially rigid). When, as in FIGS. 9A and 10, this filler material is in the central space of a doughnut-shaped tube, helium or other lighter-than-air balloons 16 (FIG. 10) are preferably imbedded in the foamed plastic or light-weight concrete.

In each of the disclosed articles the space at the center of the curved tubular means optionally may be: (1) filled with foam plastic or concrete optionally comprising balloons as in FIG. 10; or (2) hollow and open from top to bottom, as in the configuration of a presently common life buoy (the articles of FIGS. 2 to 6 optionally may be in this configuration) or their central spaces may contain foamed plastic and imbedded in this plastic, an optionally small diameter cylinder (open at its top and optionally capable of holding rain water) or a buoyant element like that of FIG. 7 or FIG. 11).

FIGS. 7 to 9, 11 and 12 illustrate an article of manufacture that may be utilized as an element to fill the central space of the buoy or the like of FIGS. 2 to 6, or used for other purposes (for example, as a balloon, ball, toy, spar buoy comprising also an anchor chain, a buoyant cable, or other buoyant device). FIG. 11 may be considered as a cross section of the elongated article of FIG. 7 or 8 or of a spherical article; when cylindrical or spherical, it may have dimensions to fit within and be glued to inner surfaces of the ring of each of FIGS. 2 to 6 that are adjacent to a central space. The buoy illustrated in FIG. 9A includes a central upright part, projecting upward from a disk-like lower portion. This part may comprise only the upper portion of a strong, elongated tube 12 or, as illustrated, such a tube that is sheathed by the foamed plastic 6, preferably having flat ends, 18. A preferable method of making this buoy of FIG. 9A comprises the following steps: (1) the doughnut-shaped tube 14 is placed in the bottom portion of a two-part mold; ( 2) the balloons 16 (if used) are placed within and near the outer periphery of the upper mold part; (3) the elongated element (the tube 12 or this tube and its envelope 6) is vertically placed in the bottom mold part and the upper part of the mold is positioned over and fastened to the bottom mold part, holding the elongated element in upright position and holding the optional balloons between the upright element and the tube 14; (4) mixed foamed-plastic liquids are inserted thru a temporarily sealable hole in the mold; and (5) after the plastic has set the completed article is removed from the mold.

The upright element projects sufficiently above the lower portion of the buoy for a survivor on the article to hold to the cylinder for aid in staying on the buoy in rough weather. The central upright part also serves as an upper buoyant element, which tends to prevent capsizing of the buoy, loaded on the top surface of its disk-like portion.

In FIG. 5 the central cylindrical element 20 optionally may terminate at the level of the top and bottom of the foamed-plastic sheath 4. Or it may project above the level of the top of the sheath, in which event it optionally is of smaller diameter than that indicated in FIG. 5, serving like the central element of FIG. 9A as a holding means for a survivor on the lower disk-like part of the buoy, and when optionally open at its top and closed at its bottom serving also to collect and hold rain water for drinking.

Within the scope of the following claims, changes in the specific disclosed structure may be made. For example, the tubular means 12 may comprise a plurality of sealed, coaxial cans, containing gaseous material, having their contiguous ends fastened together by bonding material.

In the claims, unless otherwise qualified, the term "skin means" refers to paint, or a coating of plastic, or an envelope of fabric, plastic, or the like or a plurality of skins that are joined; and the word "plastic" means any type of natural or synthetic rubber or other plastic.

I claim:

1. A hollow article of manufacture, including:

a unitary, toroidal, blown tube of thermoplastic material which is heated and blown into a desired hollow toroidal shape, the said tube having integral, solid walls of strength-providing thickness, capable of substantially resisting its breakage or bending;

the walls being of sufficient thickness and rigidity to allow the tube to independently house and support a gas substantially permanently sealed inside said toroidal tube;

a matrix of porous shape-holding material, encompassing said toroidal tube, extending outward of the tube and protecting it from shock; and waterproof skin means, sheathing the said porous material.

2. An article as set forth in claim 1, comprising a buoy, in which said thermoplastic material is blown glass.

3. An article as set forth in claim 1, comprising a buoy, in which: said thermoplastic material is solid glass that is breakable under major shock; and the porous material of said matrix is porous plastic, protecting the glass tube from breakage.

4. An article as set forth in claim 1, further including a sealed blowing tube via which said thermoplastic material has been gas-blown, extending from said tube into said matrix.

5. An article as set forth in claim 1, comprising a buoy, further including: a cylinder of waterproof material, located inside and centrally of said toroidal tube; part of the porous material of said matrix lying between portions of said tube and cylinder and in contact with the cylinder.

6. An article as set forth in claim 1, comprising a buoy, in which the said matrix includes a disk-like mass of porous, shape-holding material, located interiorly of and in contact with exterior surfaces of the said toroidal tube, and in which said article further includes a plurality of lighter-than-air balloons imbedded in said matrix, the said balloons comprising lighter-than-air gas and balloon skins filled with said gas.

7. An article as set forth in claim 1, in which the porous material of said matrix comprises cement and light-weight aggregate.

8. An article as set forth in claim 1, comprising a buoy, in which: the said matrix is substantially rectangular in exterior outline and has lighter-than-air balloons imbedded in it; and the said skin comprises paint.

9. A buoy, including:

a unitary, toroidal, gas-blown, hermetically-sealed tube of thermoplastic material that is blown into a desired hollow toroidal shape, the said tube having integral, solid, impermeable-to-gas walls of buoy-strength-providing thickness, capable of substantially resisting its breakage or bending;

the walls being of sufficient thickness and rigidity to allow the tube to independently house and support a gas substantially permanently sealed inside said toroidal tube;

a matrix of porous shape-holding material, encompassing said toroidal tube, extending outward of the tube and protecting it from shock and deformation; and waterproof skin means, sheathing the said porous material.

10. A buoy as set forth in claim 9, in which said thermoplastic material is blown glass.

11. A buoy as set forth in claim 9, further including an upright hollow element located inside said toroidal tube, a portion of said element extending above said toroidal tube, adapted to be held by a person in water; part of the porous material of said matrix lying between portions of said tube and said element and in contact with said element.

12. A buoy as set forth in claim 11, in which the said upright hollow element provides buoyancy above said toroidal tube and comprises a sealed gas-blown tube of thermoplastic material that is capable of being blown into a desired hollow shape.

* * * * *